US009354532B2

(12) United States Patent
Yoshida et al.

(10) Patent No.: US 9,354,532 B2
(45) Date of Patent: May 31, 2016

(54) METHOD OF PRODUCING ELECTROPHOTOGRAPHIC TONER, TONER CARTRIDGE, AND IMAGE FORMING APPARATUS

(71) Applicants: KABUSHIKI KAISHA TOSHIBA, Minato, Tokyo (JP); TOSHIBA TEC KABUSHIKI KAISHA, Shinagawa, Tokyo (JP)

(72) Inventors: Maiko Yoshida, Shizuoka (JP); Satoshi Araki, Shizuoka (JP); Taishi Takano, Shizuoka (JP); Takashi Urabe, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/309,725

(22) Filed: Jun. 19, 2014

(65) Prior Publication Data

US 2015/0370183 A1 Dec. 24, 2015

(51) Int. Cl.
*G03G 9/09* (2006.01)
*G03G 9/08* (2006.01)

(52) U.S. Cl.
CPC ..... *G03G 9/081* (2013.01)

(58) Field of Classification Search
CPC .. G03G 9/0804; G03G 9/0902; G03G 9/0906
See application file for complete search history.

(56) References Cited

U.S. PATENT DOCUMENTS

2005/0255402 A1* 11/2005 Hopper ..... G03G 9/0804 430/137.14
2014/0234765 A1* 8/2014 Hirai ..... G03G 15/0865 430/105

FOREIGN PATENT DOCUMENTS

JP 2010-256613 11/2011

* cited by examiner

*Primary Examiner* — Hoa V Le
(74) *Attorney, Agent, or Firm* — Patterson & Sheridan, LLP

(57) ABSTRACT

A method of producing an electrophotographic toner includes aggregation and fusion steps. The aggregation step includes obtaining aggregates by mixing a first dispersion that contains pigment particles with a second dispersion that contains fine resin particles, and aggregating the pigment particles and the fine resin particles. The fusion step includes fusing the pigment particles and the fine resin particles by heating the aggregates. When the first dispersion is mixed with the second dispersion, the sign of the mean of zeta potential of the pigment particles in the first dispersion is set to be opposite to the sign of the mean of zeta potential of the fine resin particles in the second dispersion. In the first dispersion, the proportion of the pigment particles out of the total, having a sign opposite to the sign of the mean of zeta potential of the pigment particles is 10% or less.

8 Claims, 4 Drawing Sheets

FIG. 4

| | MEAN OF ZETA POTENTIAL OF PIGMENT PARTICLES | PROPORTION OF PIGMENT PARTICLES HAVING OPPOSITE SIGN (% BY NUMBER) | MEAN OF ZETA POTENTIAL OF FINE RESIN PARTICLES | PROPORTION OF FINE RESIN PARTICLES HAVING OPPOSITE SIGN (% BY NUMBER) | EVALUATION OF PIGMENT SURFACE EXPOSURE | EVALUATION OF UNEVENNESS AND GLITTERINESS OF TEST IMAGE | PROPORTION OF AGGREGATES NOT CONTAINING PIGMENT PARTICLES (% BY NUMBER) |
|---|---|---|---|---|---|---|---|
| EXAMPLE 1 | 63 | 0 | −48 | 0 | B | B | 12 |
| EXAMPLE 2 | 58 | 0 | −48 | 0 | A | A | 4 |
| EXAMPLE 3 | 48 | 4 | −48 | 0 | A | A | 5 |
| EXAMPLE 4 | 20 | 9 | −48 | 0 | B | B | 10 |
| COMPARATIVE EXAMPLE 1 | 10 | 15 | −48 | 0 | C | C | 15 |
| COMPARATIVE EXAMPLE 2 | −20 | 0 | −48 | 0 | C | C | 46 |
| EXAMPLE 5 | 48 | 3 | −48 | 0 | A | A | 6 |
| COMPARATIVE EXAMPLE 3 | 23 | 18 | −48 | 0 | C | C | 18 |
| EXAMPLE 6 | 48 | 3 | −48 | 0 | A | A | 5 |
| COMPARATIVE EXAMPLE 4 | 20 | 14 | −48 | 0 | C | C | 17 |
| EXAMPLE 7 | −20 | 0 | 37 | 4 | A | A | 6 |
| EXAMPLE 8 | −20 | 0 | 25 | 12 | B | B | 14 |

METHOD OF PRODUCING ELECTROPHOTOGRAPHIC TONER, TONER CARTRIDGE, AND IMAGE FORMING APPARATUS

FIELD

Embodiments described herein relate generally to a method of producing an electrophotographic toner, a toner cartridge, and an image forming apparatus.

BACKGROUND

Pigments used for an electrophotographic toner (hereinafter, simply referred to as "toner" in some cases) generally have four colors including yellow, magenta, cyan, and black. However, in recent years, a high degree of decorativeness has been required for packaging, cards, and the like, and accordingly, pigments exhibiting a high degree of decorativeness are used in addition to the pigments of four colors. The pigments exhibiting a high degree of decorativeness show pearly luster, metallic luster, holographic luster, and the like. Among the pigments exhibiting a high degree of decorativeness, the pigment (also referred to as "pearl pigment"), which is obtained by covering a mica pigment showing pearly luster with fine metal oxide particles, is widely used since this pigment provides a strong metallic impression to an individual.

The pigment particles having a high degree of decorativeness generally have a large particle size. For example, the particle size of the pearl pigment particles is generally from about 5 μm to about 200 μm. The greater the particle size of pigment particles is, the higher the degree of glitteriness of the pigment particles. Moreover, the closer the shape of the pigment particles to a flat plate shape, the higher the degree of glitteriness of the pigment particles. In addition, during the formation of an image, if the flat surface of the flat plate pigment particles is disposed in parallel with the surface of the image, the degree of the glitteriness of the pigment particles is further enhanced.

In the field of related art, there is a technique relating to the formation of an electrophotographic image using a toner which utilizes highly decorative pigment particles having a large particle size. However, due to the following problems, the technique is not sufficiently reliable to be put to practical use.

Firstly, when a toner is produced using highly decorative pigment particles having a large particle size, the pigment may be crushed during the steps of kneading, grinding, and the like. Consequently, the particle size and shape of the pigment particles cannot be maintained, and glitteriness is not sufficiently exhibited thereby in some cases.

Secondly, even if the pigment particles have the shape of a flat plate, the toner image containing the pigment particles may not have the shape of a flat plate. Therefore, during the formation of an image, the surface of the tabular pigment particles is not disposed in parallel with the surface of the image, and the glitteriness is not sufficiently exhibited thereby.

Thirdly, the pigment particles are readily exposed on the surface of the toner containing the pigment particles. Consequently, the uniformity of chargeability among the toner particles may become insufficient, the toner may not be sufficiently fixed onto a medium during the formation of an image, and the member such as a photoreceptor in an image forming apparatus may be easily contaminated. Moreover, these problems may readily easily lead to image defect.

BRIEF DESCRIPTION OF THE DRAWINGS

FIG. 4 illustrates evaluation results of examples.

DETAILED DESCRIPTION

Embodiments provide a method of producing an electrophotographic toner that may reduce the incidence of image defects, a toner cartridge, and an image forming apparatus.

In general, according to one embodiment, the method of producing an electrophotographic toner according to the present embodiment includes an aggregation step and a fusion step. The aggregation step is a step of obtaining aggregates by mixing a first dispersion that contains pigment particles with a second dispersion that contains fine resin particles, and aggregating the pigment particles and the fine resin particles. The fusion step is a step of fusing the pigment particles and the fine resin particles by heating the aggregates. When the first dispersion is mixed with the second dispersion, the sign of the mean of zeta potential of the pigment particles in the first dispersion is set to be opposite to the sign of the mean, of zeta potential of the fine resin particles in the second dispersion. Moreover, in the first dispersion, the proportion of the number of pigment particles, which have the sign opposite to the sign of the mean of zeta potential of the pigment particles, in the total number of the pigment particles is set to 10% by number or less.

Hereinafter, the method of producing an electrophotographic toner according to the present embodiment will be described with reference to a drawing.

Figure 1:
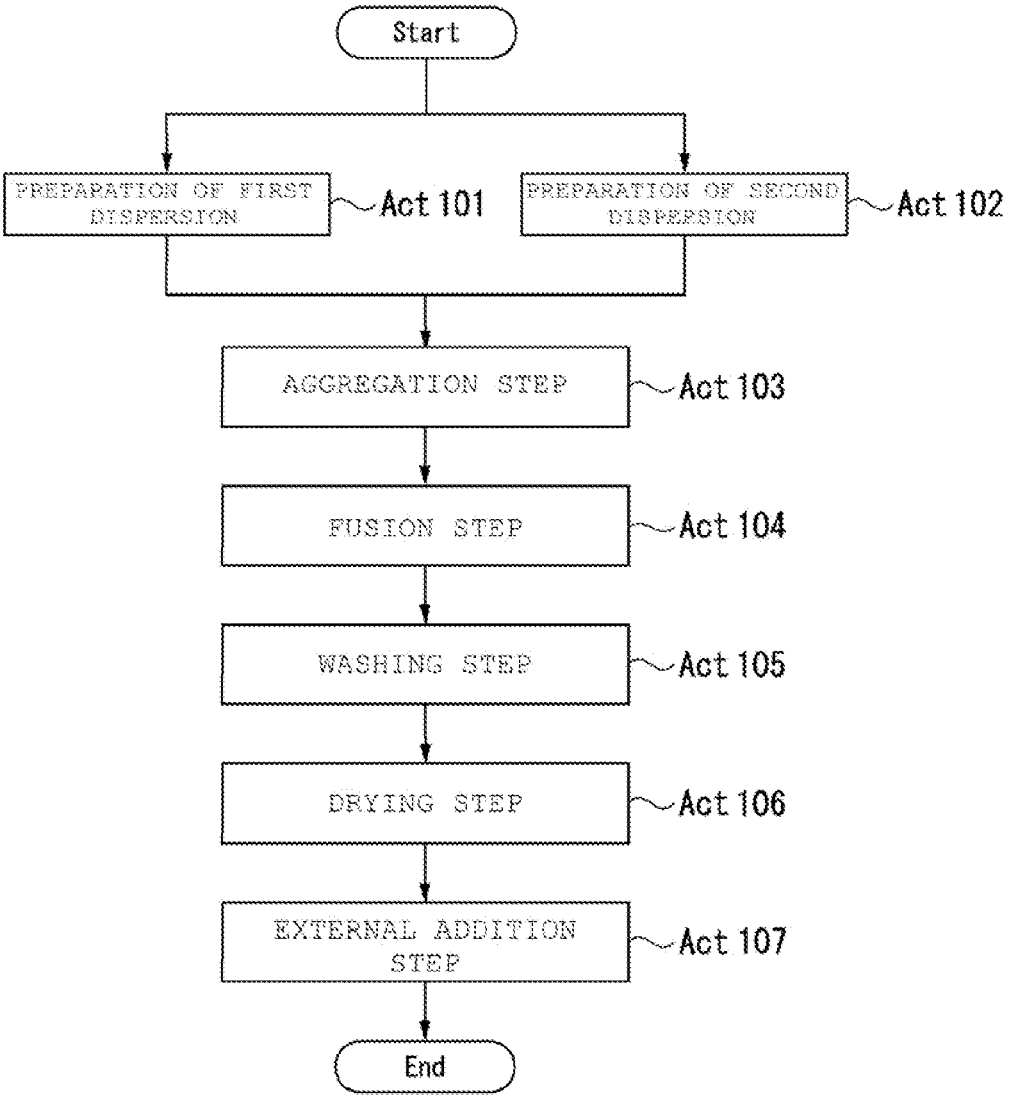
FIG. 1 schematically illustrates a method of producing an electrophotographic toner according to an embodiment.

FIG. 1 schematically illustrates the method of producing an electrophotographic toner according to an embodiment. The production method according to the present embodiment has an aggregation step (Act 103) and a fusion step (Act 104). Moreover, the production method according to the present embodiment may have a washing step (Act 105), a drying step (Act 106), end an external addition step (Act 107).

Hereinafter, the constitution of the aggregation step (Act 103) will be described.

The aggregation step according to the present embodiment is a step of obtaining aggregates containing pigment particles and fine resin particles by mixing a first dispersion that contains the pigment particles with a second dispersion that contains the fine resin particles.

The first dispersion used in the aggregation step contains pigment particles. The first dispersion is prepared before the aggregation step (Act 101 of FIG. 1).

As the pigment particles, commercially available products may be used. Alternatively, the pigment particles may be produced and used.

The type of pigment used for the pigment particles is not particularly limited, and examples thereof include organic and inorganic pigments. Specific examples of the pigment include carbon black, yellow pigments, magenta pigments, cyan pigments, glittering pigments, and the like.

Specific examples of the carbon black pigment include acetylene black, furnace black, thermal black, channel black, ketjen black, and the like.

Specific examples of the yellow pigments include C.I. Pigment Yellow 1, 2, 3, 4, 5, 6, 7, 10, 11, 12, 18, 14, 15, 16, 17, 23, 65, 73, 74, 81, 83, 93, 95, 97, 98, 109, 117, 120, 137, 138, 139, 147, 151, 154, 167, 173, 180, 181, 183, and 185; C. I. Vat Yellow 1, 3, and 20; and the like.

Specific examples of the magenta pigments include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238; C. I. Pigment Violet 19; C. I. Vat Red 1, 2, 10, 13, 15, 23, 29, and 35; and the like.

Specific examples of the cyan pigments include C. I. Pigment Blue 2, 3, 15, 16, and 17; C. I. Vat Blue 6; C. I. Acid Blue 45; and the like.

Specific examples of the glittering pigments include metal powder of aluminum, brass, bronze, nickel, stainless steel, and zinc; mica covered with titanium oxide or yellow iron oxide; barium sulfate; covered inorganic flaky crystalline substrates such as layered silicate and layered aluminosilicate; monocrystalline plate-like titanium oxide; basic carbonate; acidic bismuth oxychloride; natural guanine; flaky glass powder; metal-deposited flaky glass powder; and the like.

One kind of the pigment may be used singly, or two or more kinds thereof may be used in combination.

The volume average particle size of the pigment particles is not particularly limited, but is preferably from 6 μm to 100 μm. If the volume average particle size is 6 μm or greater, the glitteriness becomes excellent. If the volume average particle size is 100 μm or less, it is easy to cause the fine resin particles to contain, the pigment particles, and accordingly, the pigment particles are inhibited from being exposed on the surface of the toner.

The shape of the pigment particles is not particularly limited. For example, the pigment particles may have the shape of a flat plate, a cylinder, a sphere, and the like. It is preferable for the pigment particles to have the shape of a flat plate. If the pigment particles have the shape of a flat plate, at the time of forming an image, the pigment particles axe easily oriented in parallel with the surface of the image, whereby the glitteriness of the image is improved.

The type of dispersion medium for the first dispersion is not particularly limited. Examples of the dispersion medium include water, a mixture including water and a lower alcohol, and the like. The water is preferably deionized water.

The concentration of the pigment particles in the first dispersion is not particularly limited, but is preferably 5 μg/mL to 40 μg/mL.

The zeta potential of the pigment particles in the first dispersion needs to satisfy the following Conditions 1 and 2.

Condition 1: The sign of the mean of zeta potential of the pigment particles in the first dispersion needs to be opposite to the sign of the mean of zeta potential of the fine resin particles in the second dispersion, which will be described later herein.

Condition 2: In the first dispersion, the proportion (hereinafter, simply referred to as "proportion of pigment particles having the opposite sign") of the number of pigment particles, which have the sign opposite to the sign of the mean of zeta potential of the pigment particles, in the total number of the pigment particles needs to be set to 10% or less.

Figure 2:
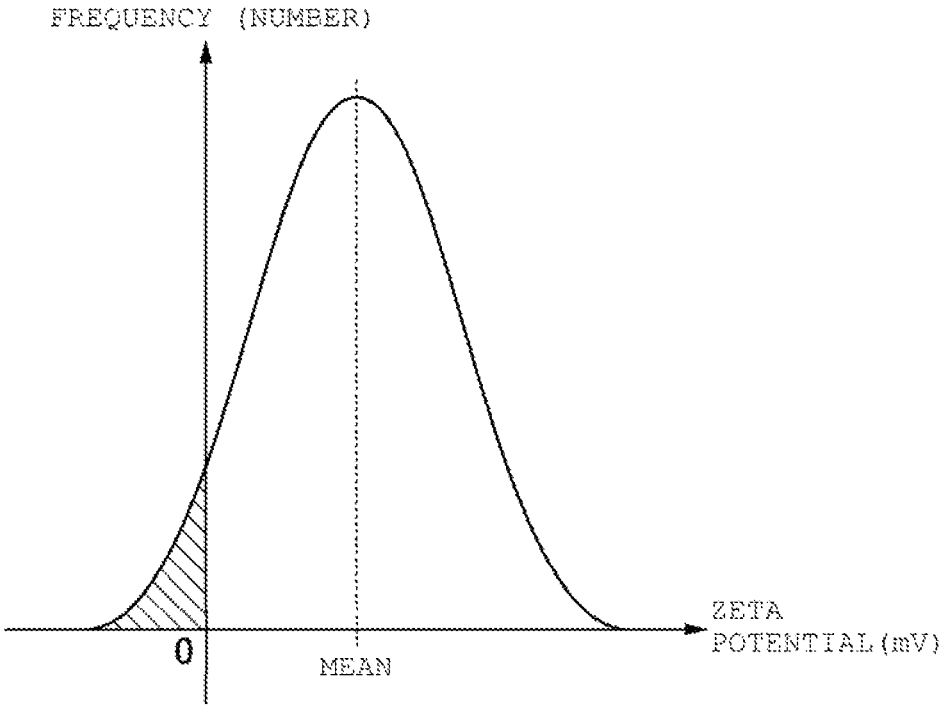
FIG. 2 illustrates an example of zeta potential, distribution of particles in a dispersion.

FIG. 2 illustrates an example of zeta potential distribution of the particles in the dispersion. In this example, the sign of the mean of zeta potential of the particles is positive. For example, when the "proportion of pigment, particles having the opposite sign" corresponds to the example, the proportion (% by number) of a value, which is obtained by integrating the potentials represented by the curve to the left of the ordinate (y axis), to the value which is obtained by integrating the potentials represented by the entire curve is the "proportion of pigment particles having the opposite sign".

By mixing the first dispersion satisfying the Conditions 1 and 2 with the second dispersion, the fine resin particles are evenly aggregated around the periphery of the pigment particles. The aggregated fine resin particles are then heated, whereby a resin layer is formed on the surface of the pigment particles. By the formation of the resin layer, the exposure of the pigment particles at the surface of the toner (hereinafter, simply described as "pigment surface exposure") does not easily occur. In the present embodiment, the proportion of the toner in which the pigment surface exposure occurred is preferably less than 10% by number, and more preferably less than 5% by number.

When the first dispersion is mixed with the second dispersion, the pigment particles practically are not further ground. Accordingly, the volume average particle size of the pigment particles is large, and the pigment particles maintain the tabular shape. Moreover, the more uniform resin layer is formed around the periphery of the tabular pigment particles, and accordingly, the shape of toner particles becomes flat. Consequently, when an image is formed, the orientation of the pigment particles contained in the toner is improved.

In the Condition 2, the proportion of the pigment particles having the opposite sign is preferably 5% by number or less. If the proportion of the pigment particles having the opposite sign is 5% by number or less, the fine resin particles are more evenly and stably aggregated around the periphery of the pigment particles. As a result, the number of aggregates not containing the pigment particles is further reduced. Generally, the chargeability of the aggregates not containing the pigment particles is different from the changeability of the toner containing the pigment particles. If the aggregates having chargeability different from that of the toner are also present in the toner containing the pigment particles, the formed image easily shows unevenness. Consequently, in the toner, the smaller the number of the aggregates not containing the pigment particles, the more difficult it is for the formed image to show unevenness. In the embodiment, the proportion of the aggregates not containing the pigment particles in the produced toner is preferably 14% by number or less, more preferably 10% by number or less, even more preferably 8% by number or less, and most preferably 6% by number or less.

In the first dispersion, the absolute value of the mean of zeta potential of the pigment particles is preferably 20 mV or greater. If the absolute value is 20 mV or greater, dispersion stability of the pigment particles is further improved. Moreover, the fine resin particles are more easily and evenly aggregated around the periphery of the pigment particles, and the shape of the pigment particles is easily maintained until the toner is produced.

As long as the zeta potential of pigment particles in a dispersion satisfies the Conditions 1 and 2, the dispersion may be directly used as the first dispersion in the production method according to the present embodiment.

When the zeta potential of the pigment particles in the first dispersion does not satisfy the Conditions 1 and 2, a zeta potential regulator is used to regulating the zeta potential of the pigment particles.

The zeta potential regulator is a compound that modifies the charged state of the particle surface in the dispersion.

An example of the zeta potential regulator includes a compound which may modify the particle surface that carries a positive charge into a negatively charged state in the dispersion. That is, the zeta potential regulator is a compound by which the value of the zeta potential may be changed to a negative value from a positive value in the dispersion.

Another example of the zeta potential regulator includes a compound which may modify the particle surface that carries a negative charge carries into a positively charged state in the dispersion. That is, the zeta potential regulator is a compound by which the value of the zeta potential may be changed, to a positive value from, a negative value in the dispersion.

Another example of the zeta potential regulator includes a compound which may modify the particle surface that carries an amphoteric charge into a positively or negatively charged state.

Examples of the zeta potential regulator usable in the present embodiment include surfactants, pH regulator, and the like.

Examples of the surfactants that may change the value of the zeta potential to a negative value from a positive value include anionic surfactants. Specific examples of the anionic surfactants include carboxylate-based surfactants, sulfuric acid ester-based surfactants, sulfonate-based surfactants, phosphoric acid esters, fatty acid salt-based surfactants, and the like. Examples of the surfactants that may change the value of the zeta potential to a positive value from a negative value include cat ionic surfactants. Specific examples of the cationic surfactants include amine salt-type surfactants, quaternary ammonium salt-type surfactants, and the like. The anionic surfactants and the cationic surfactants may be polymeric surfactants.

The zeta potential of the pigment particles carrying an amphoteric charge in the dispersion may also be regulated by regulating pH of the dispersion. The pH of the dispersion may foe regulated by the pH regulator. The type of the pH regulator is not particularly limited, and specific examples thereof include basic compounds such as sodium hydroxide, potassium hydroxide, and amine compounds; acidic compounds such as hydrochloric acid, nitric acid, and sulfuric acid; and the like. The basic compounds may regulate the zeta potential of the pigment particles carrying an amphoteric charge such that the charge becomes negative in the dispersion. The acidic compounds may regulate the zeta potential of the pigment particles carrying an amphoteric charge such that the charge becomes positive in the dispersion.

The second dispersion used in the aggregation step contains the fine resin, particles. The second dispersion is prepared before the aggregation step (Act 102 of FIG. 1).

As the fine resin particles, commercially available products may be used. Alternatively, the fine resin particles may be produced and used. When being produced, the fine resin particles may be obtained from various raw materials by a known polymerization method and the like.

The type of resin used for the fine resin particles is not particularly limited, and examples thereof include polyester resins, styrene resins, ethylene resins, acrylic resins, phenol resins, epoxy resins, allyl phthalate resins, poly amide resins, maleic acid resins, and the like. One kind of the resin may be used singly, or two or mere kinds thereof may be used in combination.

Among the above resins, polyester resins are preferable since these have a low glass transition temperature and exhibit excellent low-temperature fixability. The polyester resins may be amorphous or crystalline.

The glass transition temperature of the polyester resin is preferably from 40° C. to 70° C., and more preferably from 45° C. to 65° C. If the glass transition temperature is equal to or higher than the lower limit, the storage stability of the toner is further improved. If the glass transition temperature is equal to or lower than the upper limit, the low-temperature fixability becomes better.

The polyester resin is obtained by condensation polymerization of a polycarboxylic acid and a polyol. Examples of the polycarboxylic acid component in the polyester resin include aromatic dicarboxylic acids such as terephthalic acid, phthalic acid, and isophthalic acid; aliphatic carboxylic acids such as fumaric acid, maleic acid, succinic acid, adipic acid, sebacic acid, glutaric acid, pimelic acid, oxalic acid, malonic acid, citraconic acid, and itaconic acid; and the like. Examples of the polyol component in the resin include aliphatic diols such as ethylene glycol, propylene glycol, 1,4-butanediol, 1,3-butanediol, 1,5-pentanediol, 1,6-hexanadiol, neopentyl glycol, trimethylene glycol, trimethylolpropane, and pentaerythritol; alicyclic diols such as 1,4-cyclohexanediol and 1,4-cyclohexanedimethanol; ethylene oxide adducts or propylene oxide adducts of bisphenol A or the like; and the like.

Moreover, in the polyester resin, a crosslinked structure may be formed of a polycarboxylic acid having a valency of 3 or higher, such as 1,2,4-benzenetricarboxylic acid (trimellitic acid) and a polyol component having a valency of 3 or higher, such as glycerin.

The volume average particle size of the fine resin particles is not particularly limited, and preferably from 10 nm to 2,000 nm. The shape of the fine resin particles is not particularly limited. For example, the fine resin particles may have the shape of a sphere, a cylinder, a plate, and the like. It is preferable for the fine resin particles to have the shape of a sphere since the spherical particles are easily and evenly aggregated with the pigment, particles. When the resin does not have the desired volume average particle size or shape, the resin is further processed with a known grinding method or atomization method.

The grinder used for grinding is not particularly limited as long as it may perform grinding by a dry method. Examples of the grinder include a ball mill, an atomizer, a Bantam mill, a pulverizer, a hammer mill, a roll crusher, a cutter mill, a jet mill, and the like.

The atomizer used for atomization is not particularly limited as long as it may perform atomization by a wet method. Examples of the atomizer include high-pressure atomizers such as Nanomizer (manufactured by Yoshida Kikai Co., Ltd.), Ultimizer (manufactured by SUGINO MACHINE LIMITED), NANO3000 (manufactured by Beryu Corporation), Microfluidizer (manufactured by MIZUHO Industrial CO., LTD.), and Homogenizer (manufactured by IZUMI FOOD MACHINERY CO., LTD.); rotor and stator-type stirrers such as Ultra-Turrax (manufactured by IKA JAPAN K.K.), TK Autohomomixer (manufactured by PRIMIX Corporation), TK Pipeline Homo Mixer (manufactured by PRIMIX Corporation), TK Filmix (manufactured by PRIMIX Corporation), Clearmix (manufactured by M Technique Co., Ltd.), Clear SS5 (manufactured by is Technique Co., Ltd.), Cavitron (manufactured by EUROTEC CO., LTD.), and Fins Flow Mill (manufactured by Pacific Machinery & Engineering Co., Ltd.); media stirrers such as Viscomill (manufactured by AIMEX Corporation co., ltd.), Apex Mill (manufactured by KOTOBUKI INDUSTRIES CO., LTD.), Star Hill (manufactured by Ashizawa Finetech Ltd.), DCP SuperFlow (manufactured by Nippon Eirich Co., Ltd.), MP Mill (manufactured by INOUE MFG., INC), Spike Mill (manufactured by INOUE MFG., INC), Mighty Mill (manufactured by INOUE MFG., INC), and SC Mill (manufactured by Mitsui Mining Co., Ltd.); and the like.

The type of dispersion medium for the second dispersion is not particularly limited, and examples thereof include wafer, a mixture including water and lower alcohol, and the like. The wafer is preferably deionized water.

The concentration of the fine resin particles is appropriately set, and is preferably 5 μg/mL to 40 μg/mL.

The zeta potential of the fine resin particles in the second dispersion needs to satisfy the Condition 1. It is preferable for the zeta potential of the fine resin particles in the second dispersion to satisfy the following Condition 3.

Condition 3: In the second dispersion, the proportion (hereinafter, simply referred to as "proportion of fine resin particles having the opposite sign") of the number of fine resin particles, which have a sign opposite to the sign of the mean of zeta potential of the fine resin particles, in the total number of the fine resin particles needs to be 10% by number or less. The "proportion of fine resin particles having the opposite sign" is determined in the same manner as in the case of the "proportion of pigment particles having the opposite sign" (see FIG. 2).

If the proportion of the fine resin particles having the opposite sign is 10% by number of less, the fine resin particles are more evenly and stably aggregated around the periphery of the pigment particles. As a result, in the produced toner, the number of aggregates not containing the pigment particles is further reduced. The changeability of the aggregates not containing the pigment particles is different from the chargeability of the toner containing the pigment particles. Accordingly, in the toner, the smaller the number of the aggregates not containing the pigment particles is, the more difficult it is for the formed image to show unevenness.

If the zeta potential of resin particles in a dispersion satisfies the Condition 1, the dispersion may be directly used as the second dispersion in the production method according to the present embodiment.

When the zeta potential of the resin particles in the dispersion does not satisfy the Condition 1, a zeta potential regulator is used for regulating the zeta potential of the resin particles. Examples of the zeta potential regulator include the same ones as being used for the pigment particles described above. The zeta potential regulator used may be different from those used for regulating the zeta potential of the pigment particles.

The method of mixing the first dispersion with the second dispersion is not particularly limited. In the method, the second dispersion may be added to the first dispersion, or alternatively, the first dispersion may be added to the second dispersion. Particularly, it is preferable to add the second dispersion to the first dispersion. It is more preferable to sequentially add the second dispersion to the first dispersion. According to the method of sequential addition, heteroaggregation easily occurs between the pigment particles and the fine resin particles. In the present specification, "heteroaggregation" means that the fine resin particles are aggregated with the pigment particles.

The sequential addition means that when one of the dispersions in a predetermined amount is mixed with the other dispersion in a predetermined amount, the other dispersion is added little by little to one of the dispersions over time. The other dispersion may be added continuously or intermittently. The addition time from when the other dispersion starts to be added to when the addition period ends is preferably 1 to 40 hours, and more preferably 3 to 30 hours. If the addition time is equal to or longer than the lower limit, heteroaggregation more easily occurs between the pigment particles and the fine resin particles. If the addition time is equal or shorter than the upper limit, the production efficiency increases.

The aggregation reaction may be performed in a generally used reaction container. The reaction volume is appropriately set to various levels within a range of a laboratory scale to an industrial scale.

The mixing ratio between the first dispersion and the second dispersion ((first dispersion):(second dispersion)) is preferably 1:3 to 5:1 in terms of a volume ratio. Moreover, the mass ratio of the fine resin particles to the pigment particles is preferably 100% by mass to 1,900% by mass.

If necessary, the first dispersion, the second dispersion, and a dispersion obtained by mixing these dispersions together may contain optional components. Examples of the optional components include an aggregation agent, a charge control agent, a release agent, a surfactant, and the like.

The aggregation agent is used for accelerating the aggregation of the pigment particles and the fine resin particles.

The type of the aggregation agent is not particularly limited, and specific examples thereof include monovalent metal salts such as sodium chloride; polyvalent metal salts such as magnesium sulfate and aluminum sulfate; non-metal salts such as ammonium chloride and ammonium sulfate; acids such as hydrochloric acid and nitric acid; strong cationic coagulants based on poly amine, poly-DADMAC, and the like.

The charge control agent is used to control the changeability of the toner and makes it easy for the toner to be transferred to a medium such as paper.

Examples or the charge control agent include metal-containing azo compounds, metal-containing salicylic acid derivative compounds, and the like. The metal elements of the metal-containing azo compounds are preferably complexes or complex salts of iron, cobalt, or chromium, or a mixture of these. The metal elements of the metal-containing salicylic acid derivative compounds are preferably complexes or complex salts of zirconium, zinc, chromium, or boron, or a mixture of these.

The release agent is used to prevent the transferred toner from adhering to a fixing roller in an image forming apparatus.

Examples of the release agent include aliphatic hydrocarbon-based waxes such as low-molecular weight polyethylene, low-molecular weight polypropylene, a polyolefin copolymer, polyolefin wax, paraffin wax, and Fischer-Tropsch wax, and modified products of these; plant waxes such as candelilla waxes, carnauba wax, Japan tallow, jojoba wax, and rice wax; animal waxes such as beeswax, lanolin, and spermaceti; mineral waxes such as montan wax, ozokerite, and ceresine; fatty acid amides such as linolic acid amide, oleic acid amide, and lauric acid amide; functional synthetic waxes; silicone-based waxes; and the like.

The surfactant is used to improve the dispersion stability of the aggregates in the dispersion.

The type of surfactant is not particularly limited, and examples thereof include anionic surfactants such as a sulfuric ester salt-based surfactant, a sulfonate-based surfactant, a phosphoric acid ester-based surfactant, and a fatty acid salt-based surfactant; cationic surfactants such as an amine salt-type surfactant and a quaternary ammonium salt-type surfactant; amphoteric surfactants such as betaine-based surfactants; nonionic surfactants such as a polyethylene glycol-based surfactant, an alkylphenol ethylene oxide adduct-based surfactant, and a polyol-based surfactant; polymeric surfactants such as polycarboxylic acid; and the like.

Hereinafter, the constitution of the fusion step (Act 104) will be described.

The fusion step according to the present embodiment is a step of fusing the pigment particles and the fine resin particles by heating the aggregates obtained in the aggregation step. The fusion step may be performed simultaneously with the aggregation step.

The heating apparatus may be a generally used heater. The heating temperature is preferably from the glass transition temperature of the fine resin particles to (glass transition temperature+40° C.). The heating time is preferably 2 to 10 hours.

The volume average particle size of the aggregates obtained after the fusion step is preferably 1.2 times to 8 times greater than the volume average particle size of the pigment particles.

Hereinafter, the constitution of the washing step (Act 105) will be described.

The present embodiment may have the washing step in which the aggregates are washed, after the fusion step.

The washing step is performed appropriately by a known washing method. For example, the washing step is performed by repeating washing using deionized water and filtration. It is preferable for the washing step to be repeated until the conductivity of the filtrate becomes 100 μS/cm or less. It is more preferable for the washing step to be repeated until the conductivity becomes 50 μS/cm or less.

Hereinafter, the constitution of the drying step (Act 106) will be described.

The present embodiment may have the drying step is which the aggregates are dried, after the washing step.

The drying step is appropriately performed by a known drying method. For example, the drying step is performed using a vacuum drier. It is preferable for the drying step to be performed until the moisture content of the aggregates becomes 2.0% by mass or less. It is more preferable for the drying step to be performed until the moisture content becomes 1.0% by mass or less.

Hereinafter, the constitution of the external addition step (Act 107) will be described.

The present embodiment may have an external addition step in which external additives are added to the aggregates, after the drying step.

Examples of the external additives include inorganic particles and fine resin particles. The inorganic particles are added to impart fluidity or chargeability to the toner. The fine resin particles are added to improve the cleaning properties of a photoreceptor drum and an intermediate transfer belt at the time of forming an image.

Examples of the inorganic particles include inorganic oxides such as silica, titania, alumina, strontium titanate, and tin oxide. From the viewpoint of improving environmental stability, it is preferable to use the inorganic particles having undergone surface treatment with a hydrophobizing agent.

The fine resin particles may be the same as the fine resin particles described above.

The toner cartridge according to the present embodiment contains the electrophotographic toner produced by the production method described above. The toner cartridge may be in the known form, as long as it contains the toner.

The feature of the image forming apparatus according to the present embodiment is that the apparatus uses the electrophotographic toner produced by the production method described above. As the image forming apparatus, a general electrophotographic apparatus may be used.

Figure 3:
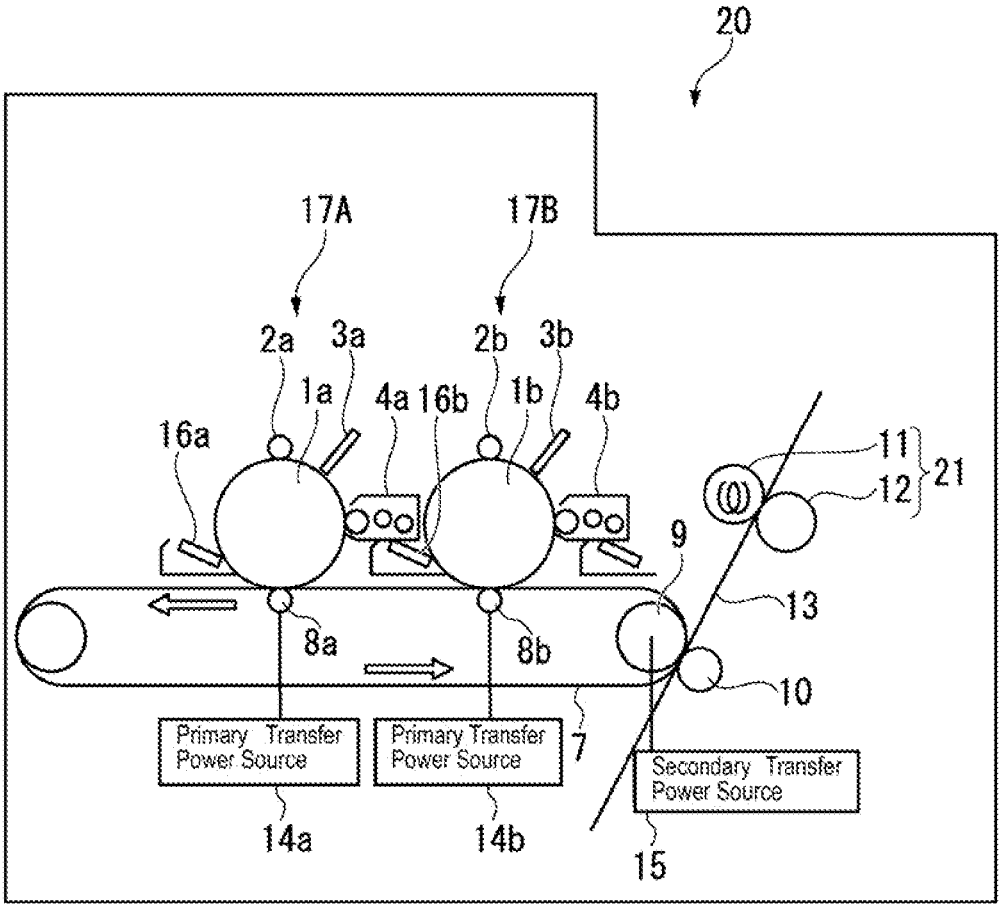
FIG. 3 is a view schematically illustrating an example structure of an image forming apparatus according to the embodiment.

FIG. 3 is a view schematically illustrating an example structure of the image forming apparatus according to the present embodiment.

As illustrated in the drawing, an image forming apparatus 20 has an intermediate transfer belt 7, a first image forming unit 17A and a second image forming unit 17B that are disposed in this order on the intermediate transfer belt 7, and a fixing device 21 that is disposed downstream thereof in the printing media path. In the movement direction of the intermediate transfer belt 7, in other words, in the direction in which the image formation process is performed, the first image forming unit 17A is positioned downstream of the second image forming unit 17B.

The first image forming unit 17A has a photoreceptor drum 1*a*, a cleaning device 16*a*, a charging device 2*a*, an exposure device 3*a*, and a first developing unit 4*a* that are disposed in this order on the photoreceptor drum 1*a*, and a primary transfer roller 8*a* that is disposed to face the photoreceptor drum 1*a* across the intermediate transfer belt 7.

The second image forming unit 17B has a photoreceptor drum 1*b*, a cleaning device 16*b*, a charging device 2*b*, an exposure device 3*b*, and a second developing unit 4*b* that are disposed in this order on the photoreceptor drum 1*b*, and a primary transfer roller 8*b* that is disposed to face the photoreceptor drum 1*b* across the intermediate transfer belt 7.

Downstream of the second image forming unit 17B, a secondary transfer roller 9 and a backup roller 10 are disposed such that the rollers face each other across the intermediate transfer belt 7. The toner in the first developing unit 4*a* and the toner in the second developing unit 4*b* may be supplied from toner cartridges (not illustrated in the drawing).

The primary transfer roller 8*a* and primary transfer roller 8*b* are connected to primary transfer power sources 14*a* and 14*b* respectively. The secondary transfer roller 9 is connected to a secondary transfer power source 15.

The fixing device 21 has a heat roller 11 and a press roller 12 that are disposed to face each other.

By using the image forming apparatus of FIG. 3, an image may be formed by, for example, the following method.

First, the photoreceptor drum 1*b* is evenly charged by the charging device 2*b*.

Next, exposure is performed by the exposure device 3*b*, whereby an electrostatic latent image is formed. Thereafter, the image is developed with an uncolored aromatic toner of the developing unit 4*b*, whereby a second toner image is obtained.

Subsequently, the photoreceptor drum, la is evenly charged by the charging device 2*a*.

Next, based on first image information, exposure is performed by the exposure device 3*a*, whereby an electrostatic latent image is formed.

The image is developed with the toner of the developing unit 4*a*, whereby a first toner image is formed.

The second toner image and the first toner image are transferred in this order onto the intermediate transfer belt 7 by the primary transfer rollers 8*a* and 8*b*.

The image, which is composed of the second toner image and the first toner image that are layered on the intermediate transfer belt 7 in this order, is transferred by secondary transfer onto a recording medium not illustrated in the drawing via the secondary transfer roller 9 and the backup roller 10. As a result, an image composed of the first toner image and the second toner image that are layered on the recording medium 13 in this order is formed.

The electrophotographic toner produced by the production method according to the present embodiment may be accommodated in any of the developing unit 4*a* and the developing unit 4*b*. The type of pigment is optionally selected. There may be three or more developing units depending on the number of toner types used.

According to the present embodiment, the aggregation method is used. Therefore, the pigment particles are not crushed by the mechanical shearing force, as they are in the grinding method.

Moreover, the present embodiment is characterized in that the zeta potential of the pigment particles in the first dispersion and the fine resin particles in the second dispersion is regulated.

In the present embodiment, due to the above characteristics the fine resin particles of nano-order are evenly aggregated on the surface of the pigment particles. Accordingly, for example, when the pigment is a glittering pigment, the pigment particles are evenly contained in the fine resin particles while maintaining the volume average particle size and shape by which the pigment particles may sufficiently exhibit glitteriness. That is, when the toner containing the glittering pigment is produced by the present embodiment, the toner contains more tabular pigment particles having a large volume average particle size. Furthermore, when an image is formed of the toner, the pigment particles are easily oriented in parallel with the surface of the image. Consequently, the image formed, of the toner exhibits excellent glitteriness.

Due to the above characteristics, the pigment surface exposure occurs less in the present embodiment. Accordingly, no matter what kind of pigment is used, image defect does not easily occur.

Due to the above characteristics, heteroaggregation easily occurs between the pigment particles and the fine resin particles in the present embodiment, and accordingly, the number of aggregates not containing the pigment particles is reduced. As a result, if an image is formed using the toner produced by the present embodiment, no matter what kind of pigment is used, unevenness is not easily caused in the image.

An example according to the present embodiment is described in the following examples. However, the present embodiment is not limited to the examples.

Hereinafter, how to measure the zeta potential will be described.

After the zeta potential was regulated, in order to measure the zeta potential, the solid content concentration of the pigment particles and the fine resin particles was adjusted to be 50 ppm. The zeta potential of the pigment particles and the fine resin particles was measured by ZEECOM ZC-3000 (manufactured by Microtec Co., Ltd.). The zeta potential of 100 pigment particles and 100 fine resin particles was manually measured. The proportion of the pigment particles having the opposite sign and the proportion of the fine resin particles having the opposite sign, were determined as described above (see FIG. 2).

Hereinafter, how to evaluate the pigment surface exposure will be described.

The pigment surface exposure was evaluated by observing images captured by a scanning electron microscope (SEM). In order to perform the evaluation, the proportion of the toner in which the pigment surface exposure had occurred was determined. The evaluation criteria are as follows.

A: The proportion of the toner in which the pigment surface exposure occurred is less than 5% by number.

B: The proportion of the toner in which the pigment surface exposure occurred is 5% by number or higher but less than 10% by number.

C: The proportion of the toner in which the pigment surface exposure occurred is 10% by number or higher.

Hereinafter, how to evaluate the unevenness and glitteriness of a test image will be described.

A developer was prepared by mixing ferrite carriers, which were covered with a silicone resin, with the toner produced in each example or comparative example. The developer was prepared such that the content of the toner in the developer became 8% by mass. A test image was formed on ordinary paper by a multifunction machine ("e-studio 4520c" manufactured by TOSHIBA TEC CORPORATION) in a room temperature and normal humidify atmosphere. Moreover, the image was fixed using an external fixing device which was modified to make it possible to coat a fixing roller with silicone oil, such that offset did not occur. The evaluation criteria of unevenness and glitteriness of the test image are as follows.

A: The test image does not show unevenness and exhibits glitteriness.

B: The test image shows slight unevenness and exhibits glitteriness.

C: The test image shows unevenness and does not exhibit glitteriness.

When pigments other than the glittering pigment were used, the glitteriness was not evaluated, and only the unevenness was evaluated.

Hereinafter, hot to evaluate the number of the aggregates not containing the pigment particles will be described.

The produced toner was embedded in an epoxy resin. The toner was cut into ultra-thin slices having a thickness of 100 nm by Ultramicrotome (manufactured by LEICA MICROSYSTEMS). The number of aggregates not containing the pigment particles was evaluated by image analysis by using a transmission electron microscope (TEM) ("JEM-1010" manufactured by JEOL DATUM Ltd.). For the image analysis, an image processor and analyzer "LUZEX III" (manufactured by Nireco Corporation) was used. The proportion of the number of the aggregates not containing the pigment particles was calculated by determining the proportion (% by number) of the number of the aggregates not containing the pigment particles in 100 aggregates.

Example 1

Hereinafter, the process of preparing a dispersion containing pigment particles will be described.

First, 12 parts by mass of Iriodin 120 (manufactured by Merck KGaA) as a glittering pigment was dispersed in 174 parts by mass of deionized water, thereby obtaining a dispersion A containing pigment particles. At this stage, the zeta potential of the pigment particles had not yet been regulated.

In the present example, polydiallyldimethylammonium chloride ("Shallol Dc303P" manufactured by DAI-ICHI KOGYO SEIYAKU CO., LTD.) was used as a zeta potential regulator. 19 Parts by mass of a 0.5% by mass polydiallyldimethylammonium chloride solution was added to the dispersion A under stirring. The dispersion whose zeta potential was regulated was named a "dispersion B". The zeta potential of the pigment particles contained in the dispersion B was measured. The mean of the zeta potential of the pigment particles and the proportion of the pigment particles having the opposite sign are described in FIG. 4.

In the present example, before the dispersion containing the pigment particles was mixed with a dispersion containing fine resin particles, an ammonium sulfate solution as an aggregation agent was added to the dispersion B. Specifically, first, the dispersion B was heated up to 45° C. Subsequently, 30 parts by mass of a 30% by mass ammonium sulfate solution as an aggregation agent was added to the dispersion B. Next, the dispersion B was allowed to stand still for 1 hour. The dispersion to which the aggregation agent was added was named a "dispersion C".

Hereinafter, the process of preparing a dispersion containing fine resin particles will be described.

30 Parts by mass of a polyester resin (acid value of 10 mg KOH/g, Mw of 15,000, and Tg of 58° C.), 1 part by mass of sodium dodecylbenzene sulfonate (Neopelex G15 manufactured by Kao Corporation), and 69 parts by mass of deionized water were mixed together, thereby obtaining a dispersion. The pH of the dispersion was regulated to 12 by potassium hydroxide.

The fine resin particles were processed with a high-pressure homogenizer ("NANO 3000" manufactured by Beryu Corporation), whereby the volume average particle size thereof was regulated. The process was performed under the conditions of 150° C. and 150 mPa. After the process, the volume average particle size of the fine resin particles was measured by SALD 7000 (manufactured by Shimadzu Corporation). As a result, the volume average particle size was confirmed to be 0.23 μm (standard deviation of 0.15 μm). Moreover, the particle size distribution was sharp. The dispersion whose particle size was regulated was named a "dispersion D". The zeta potential of the fine resin particles contained in the dispersion D was measured. Moreover, the mean of the zeta potential of the fine resin particles and the proportion of the fine resin particles having the opposite sign are described in FIG. 4.

60 Parts by mass of the dispersion B was dispersed in 50 parts by mass of deionized water, thereby obtaining a dispersion containing fine resin particles. The dispersion was named a "dispersion E".

Hereinafter, the process of producing an electrophotographic toner will be described.

The dispersion E was added to the dispersion C over 10 hours (aggregation step), and as a result, aggregates were obtained. The particle size of the aggregates was measured by SALD 7000 (manufactured by Shimadzu Corporation). As a result, the volume average particle size of the aggregates was confirmed to be 17.8 μm. The dispersion was named a "dispersion F".

Thereafter, 5 parts by mass of a polycarboxylic acid-based surfactant (Poiz 520 manufactured by Kao Corporation) was added to the dispersion F. Subsequently, the dispersion F was heated to 65° C. and allowed to standstill (fusion step). Next, the dispersion was filtered and suspended in deionized water repeatedly until the conductivity of the filtrate became 50 μS/cm (washing step). Then the aggregates obtained after the final filtration were dried by a vacuum drier until the moisture content thereof became 1.0% by mass or less (drying step). Thereafter, 2 parts by mass of hydrophobic silica and 0.5 parts by mass of titanium oxide as external additives were caused to adhere to the surface of the aggregates (external addition step).

A toner of Example 1 was obtained as above.

Example 2

In Example 2, the amount of the deionized water for preparing the dispersion containing pigment particles was set to 178 parts by mass. Moreover, the amount of the 0.5% by mass polydiallyldimethylammonium chloride solution was set to 15 parts by mass. Moreover, the volume average particle size of the aggregates was 17.6 μm. The same process as in Example 1 was performed, except for the above points.

A toner of Example 2 was obtained as above.

Example 3

In Example 3, the amount of the deionized water for preparing the dispersion containing pigment particles was set to 133 parts by mass. Moreover, the amount of the 0.5% by mass polydiallyldimethylammonium chloride solution was set to 10 parts by mass. Moreover, the volume average particle size of the aggregates was 18.0 μm. The same process as in Example 1 was performed, except for the above points.

A toner of Example 3 was obtained as above.

Example 4

In Example 4, the amount of the deionized water for preparing the dispersion containing pigment particles was set to 186 parts by mass. Moreover, the amount of the 0.5% by mass polydiallyldimethylammonium chloride solution was set to 7 parts by mass. Moreover, the volume average particle size of the aggregates was 17.3 μm. The same process as in Example 1 was performed, except for the above points.

A toner of Example 4 was obtained as above.

Comparative Example 1

In Comparative Example 1, the amount of the deionized water for preparing the dispersion containing pigment particles was set to 187 parts by mass. Moreover, the amount of the 0.5% by mass polydiallyldimethylammonium chloride solution was set to 6 parts by mass. Moreover, the volume average particle size of the aggregates was 17.0 μm. The same process as in Example 1 was performed, except for the above points.

A toner of Comparative Example 1 was obtained as above.

Comparative Example 2

In Comparative Example 2, in preparing the dispersion containing pigment particles, the 0.5% by mass polydiallyldimethylammonium chloride solution was not added to the dispersion. That is, in the present comparative example, the zeta potential of the pigment particles was not regulated. The same process as in Example 1 was performed, except for the above points.

A toner of Comparative Example 2 was obtained as above.

Example 5

In Example 5, a black pigment which is not a glittering pigment was used as pigment particles, instead of the Iriodin 120. The dispersion containing pigment particles was prepared as below.

First, by using a homogenizer, 10 parts by mass of carbon black ("Moul L." manufactured by Cabot Corporation) as a black pigment, 1 part by mass of sodium dodecylbenzene sulfonate ("Neopelex G15" manufactured by Kao Corporation), and 89 parts by mass of deionized water were mixed together. The pigment particles was process with a high-pressure homogenizer ("NANO 3000" manufactured by Beryu Corporation), whereby the particle size thereof was regulated. After the process, the particle size of the fine resin particles was measured by SALD 7000 (manufactured by Shimadzu Corporation). As a result, the volume average particle size of the fine resin particles was 98.5 μm. The obtained dispersion was named a "dispersion G".

120 Parts by mass of the dispersion G was dispersed in 78 parts by mass of deionized water, thereby obtaining a dispersion H containing pigment particles. At this stage, the zeta potential of the pigment particles had not yet been regulated.

7 Parts by mass of a 0.5% by mass polydiallyldimethylammonium chloride solution was added to the dispersion H under stirring. As a result, the zeta potential ox the pigment particles was regulated. The zeta potential of the pigment particles contained in the dispersion whose zeta potential was regulated was measured. The mean of the zeta potential of the pigment particles and the proportion of the pigment particles having the opposite sign are described in FIG. 4.

The same process as in Example 1 was performed, except for the above points.

A toner of Example 5 was obtained as above.

Comparative Example 3

In Comparative Example 3, the amount of the deionized water for preparing the dispersion containing pigment particles was set to 80 parts by mass. Moreover, the amount of the 0.5% by mass polydiallyldimethylammonium chloride solution was set to 5 parts by mass. In addition, the volume average particle sire of the aggregates was 103.8 μm. The same process as in Example 5 was performed, except for the above points.

A toner of Comparative Example 3 was obtained as above.

Example 6

In Example 6, Iriodin 153 (manufactured by Merck KGaA) as a glittering pigment was used instead of Iriodin 120. Moreover, the amount of the deionized water for preparing the dispersion containing pigment particles was set to 186 parts by mass. In addition, the amount of the 0.5% by mass polydiallyldimethylammonium chloride solution was set to 7 parts by mass. Furthermore, the volume average particle size of the aggregates was 62.4 μm. The same process as in Example 1 was performed, except for the above points.

A toner of Example 6 was obtained as above.

Comparative Example 4

In Comparative Example 4, the amount of the deionized wafer for preparing the dispersion containing pigment particles was set to 188 parts by mass. In addition, the amount of the 0.5% by mass polydiallyldimethylammonium chloride solution was set to 5 parts by mass. Furthermore, the volume average particle size of the aggregates was 63.7 μm. The same process as in Example 6 was performed, except for the above points.

A toner of Comparative Example 4 was obtained as above.

Example 7

In Example 7, in preparing the dispersion containing pigment particles, the 0.5% by mass polydiallyldimethylammonium chloride solution was not added to the dispersion. That is, in the present example, the zeta potential of the pigment particles was not regulated.

On the contrary, in preparing the dispersion containing fine resin particles, the zeta potential of the fine resin particles in the dispersion D was regulated. Specifically, first, 43 parts by mass of deionized water was added to the dispersion D under stirring. Thereafter, 7 parts by mass of the 0.5% by mass polydiallyldimethylammonium chloride solution was added to the dispersion. The same process as in Example 1 was performed, except for the above points. The volume average particle size of the aggregates was 17.5 μm.

A toner of Example 7 was obtained as above.

Example 3

In Example 8, 43 parts by mass of deionized water was added to the dispersion D under stirring. Thereafter, 7 parts by mass of the 0.5% by mass polydiallyldimethylammonium chloride solution was added to the dispersion. The same process as in Example 7 was performed, except for the above points. The volume average particle size of the aggregates was 16.4 μm.

A toner of Example 8 was obtained as above.

FIG. 4 illustrates the evaluation results obtained from the toners prepared in Examples 1 to 8 and Comparative Examples 1 to 4.

In Comparative Examples 1, 3, and 4, the sign of the mean of zeta potential of the pigment particles was opposite to the sign of mean of zeta potential of the fine resin particles. However, in Comparative Example 1, the proportion of the pigment particles having the opposite sign was 15% by number. In Comparative Example 3, the proportion of the pigment particles having the opposite sign was 18% by number. In Comparative Example 4, the proportion of the pigment particles having the opposite sign was 14% by number. These results show that in the toners of Comparative Examples 1, 3, and 4, the pigment surface exposure occurs to a large extent. The results also show that the toners make the test image show unevenness, do not exhibit glitteriness, and contain a high proportion of aggregates not containing the pigment particles.

In Comparative Example 2, the proportion of the pigment particles having the opposite sign was 0% by number. However, in Comparative Example 2, the sign of the mean of zeta potential of the pigment particles was the same as the sign of the mean of zeta potential of the fine resin particles. These results show that in the toner of Comparative Example 2, the pigment surface exposure occurs to a large extent. The results also show that the toner makes the test image show unevenness, does not exhibit glitteriness, and contains a high proportion of aggregates not containing the pigment particles.

On the contrary, in Examples 1 to 7, the sign of the mean of zeta potential of the pigment particles was opposite to the sign of the mean of zeta potential of the fine resin particles. Moreover, in Examples 1 to 7, the proportion of the pigment particles having the opposite sign was 10% by number or less. These results show that in the toner of Examples 1 to 7, the pigment surface exposure occurs less. The results also show that the toner makes the test image show unevenness to a small extent, exhibit a high degree of glitteriness, and contains a low proportion of aggregates not containing the pigment particles.

According to at least one of the embodiments described above, the aggregation method is used, and the zeta potential of the pigment particles in the first dispersion and the fine resin particles in the second dispersion is regulated. Therefore, excellent glitteriness is imparted to an image, and it is possible to make it difficult for image defect to occur.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method of producing an electrophotographic toner, comprising:

obtaining aggregates by mixing a first dispersion that contains pigment particles having an average diameter between 6 μm and 100 μm with a second dispersion that contains fine resin particles, and aggregating the pigment particles and the fine resin particles; and fusing the pigment particles and the fine resin particles by heating the aggregates, wherein a sign of a mean of zeta potential of the pigment particles in the first dispersion is positive and a sign of a mean of zeta potential of the fine resin particles in the second dispersion is negative, and in the first dispersion, 10% or less of the pigment particles have a negative charge.

2. The method according to claim 1, wherein in the obtaining of aggregation, the second dispersion is sequentially added to the first dispersion.

3. The method according to claim 1, wherein in the second dispersion, 10% or less of the fine resin particles have a positive charge.

4. The method according to claim 1, wherein in the first dispersion, 5% or less of the pigment particles have a negative charge.

5. The method according to claim 1, wherein in the first dispersion, an absolute value of the mean of zeta potential of the pigment particles is 20 mV or higher.

6. The method according to claim 1, wherein the pigment particles are flat particles.

7. The method according to claim 1, further comprising:

preparing the first dispersion or the second dispersion in advance by using a zeta potential regulator.

8. The method according to claim 1, wherein in the produced electrophotographic toner, the proportion of aggregates not containing the pigment particles is 14% by number or less.

* * * * *